US007339320B1

(12) United States Patent
Meddaugh et al.

(10) Patent No.: US 7,339,320 B1
(45) Date of Patent: Mar. 4, 2008

(54) STANDING WAVE PARTICLE BEAM ACCELERATOR

(75) Inventors: Gard E. Meddaugh, Mountain View, CA (US); Mark E. Trail, Menlo Park, CA (US); David Whittum, Sunnyvale, CA (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 309 days.

(21) Appl. No.: 10/745,947

(22) Filed: Dec. 24, 2003

(51) Int. Cl.
*H01J 25/10* (2006.01)

(52) U.S. Cl. ..... 315/5.41; 315/500

(58) Field of Classification Search ..... 315/5.39, 315/5.41, 5.42, 5.46, 500–506
See application file for complete search history.

(56) References Cited

U.S. PATENT DOCUMENTS

| | | | | |
|---|---|---|---|---|
| 3,820,035 | A | 6/1974 | Meddaugh | 315/5.13 |
| 4,286,192 | A * | 8/1981 | Tanabe et al. | 315/5.41 |
| 4,382,208 | A | 5/1983 | Meddaugh et al. | 315/5.41 |
| 4,629,938 | A | 12/1986 | Whitham | 315/5.41 |
| 4,651,057 | A * | 3/1987 | Uetomi et al. | 315/5.41 |
| 5,039,910 | A * | 8/1991 | Moriguchi et al. | 315/5.41 |
| 5,381,072 | A | 1/1995 | Tanabe | 315/5.41 |
| 5,821,694 | A | 10/1998 | Young | 315/5.41 |
| 6,366,021 | B1 * | 4/2002 | Meddaugh et al. | 315/5.41 |
| 6,376,990 | B1 * | 4/2002 | Allen et al. | 315/5.41 |
| 6,407,505 | B1 * | 6/2002 | Bertsche | 315/5.41 |
| 6,465,957 | B1 | 10/2002 | Whitham et al. | 315/5.41 |
| 6,493,424 | B2 | 12/2002 | Whitham | 378/137 |
| 6,593,696 | B2 | 7/2003 | Ding et al. | 315/5.41 |
| 6,646,383 | B2 * | 11/2003 | Bertsche et al. | 315/5.41 |

OTHER PUBLICATIONS

International Search Report and Written Opinion from related PCT application No. PCT/US2004/043235 mailed on Apr. 7, 2006.

* cited by examiner

*Primary Examiner*—Wilson Lee
(74) *Attorney, Agent, or Firm*—Bingham McCutchen LLP

(57) ABSTRACT

An accelerator for accelerating a particle beam includes a main body having a plurality of electromagnetic cavities coupled in series, and a first coupling body having a first side cavity coupled to one of the electromagnetic cavities through a first opening, and to another of the electromagnetic cavities through a second opening, wherein the first opening and the second opening have different configurations. The accelerator further includes a pair of conductive capacitively coupled noses secured to side walls of the first coupling body, wherein the pair of noses have equal lengths.

33 Claims, 4 Drawing Sheets

STANDING WAVE PARTICLE BEAM ACCELERATOR

BACKGROUND OF THE INVENTION

1. Field of the Invention

This invention relates generally to standing wave particle beam accelerators, and more particularly, to electron accelerators for generating x-ray and electron beams of different energies.

2. Background of the Invention

Standing wave particle beam accelerators have found wide usage in medical accelerators where the high energy particle beam is employed to generate x-rays. In this application, the beam energy and output dose-rate must be stable. It is also desirable that the energy of the particle beam be switchable readily and reliably to provide treatment beams of different energies to enable a range of dose-depth penetration during medical treatments.

Various techniques for controlling the beam energy have been employed. In U.S. Pat. No. 4,286,192 to Tanabe and Vaguine, the energy is controlled by reversing the accelerating fields in one part of the accelerator to decelerate the beam. In U.S. Pat. No. 4,382,208 to Meddaugh et al., the electromagnetic field distribution is changed in the switch-side cavity to control the fields applied to the adjacent resonator cavities. U.S. Pat. No. 4,746,839 to Kazusa and Yoneda discloses the use of two coupling cavities which are switched to control the acceleration fields.

Accelerators employing the previously described techniques can generally provide two to three different x-ray modalities (i.e., distinguished by clinically significant differences in energy levels) sufficient to meet treatment requirements. There would be a significant advantage however, both to the hospitals and the manufacturing process, to have an accelerator system capable of generating multiple high output x-ray modalities ranging over a factor of four to five in energy. From a manufacturing perspective, accelerators limited to 2 to 3 modalities are difficult and costly to implement. Currently, different modalities are configured by means of manufacturing different accelerator structures to provide different ranges of beam energies in order to meet energy requirements for different hospitals. As such, if a hospital changes its energy beam requirement, a different accelerator will have to be built. For the foregoing reason, there is a need for a standing wave electron accelerator capable of providing a range of energies that is broad enough to meet all hospital requirements. In addition, there is potential benefit in many medical procedures to have more than two levels of output x-ray energy to provide more sophisticated tailoring of dose-depth profile for treatment of cancer. As such, a standing wave particle beam accelerator which is capable of providing a plurality of levels of different output energy is desirable.

SUMMARY OF THE INVENTION

In accordance with some embodiments, an accelerator for accelerating a particle beam is provided. The accelerator includes a main body having a plurality of electromagnetic cavities coupled in series, and a first coupling body having a first side cavity coupled to one of the electromagnetic cavities through a first opening, and to another of the electromagnetic cavities through a second opening, wherein the first opening and the second opening have different configurations. The accelerator further includes a pair of conductive capacitively coupled noses secured to side walls of the first coupling body, wherein the pair of noses have equal lengths. By configuring the first and the second openings to be different, separations between resonant modes are reduced. However, such configuration also allows an energy switch to operate in a wider range of energy levels without significantly increasing interactions between adjacent modes. This in turn provides a broader bandwidth for the accelerator when an energy switch is in use, allowing the accelerator to generate x-ray beams with a broader range of energy levels and minimum energy spread.

In accordance with some embodiments, an accelerator for accelerating a particle beam is provided. The accelerator includes a main body having a plurality of electromagnetic cavities coupled in series along an axis, a coupling body having a side cavity coupled to two of the electromagnetic cavities, and an energy switch having a probe for changing an electric field distribution in the side cavity, wherein the probe has an axis that is parallel and offset from an axis of the coupling body, and the probe is mounted such that an electromagnetic field coupling between the two of the electromagnetic cavities can be changed by varying a degree of insertion of the probe into the second side cavity.

In accordance with some embodiments, a field step control is provided. The field step control includes a coupling body having a first end, a second end, a cavity extending between the first and the second ends, and a pair of conductive capacitively coupled noses secured to side walls of the coupling body, the pair of noses having equal lengths, wherein the first end is sealed, the second end is secured to a wall having a first opening and a second opening, and the first opening has a cross sectional dimension that is different from a cross sectional dimension of the second opening. The field step control allows an accelerator to achieve a balance between optimized operational stability and optimized operational range. This in turn allows the accelerator to generate x-ray beams with a wider range of energy levels and minimum energy spread.

In accordance with other embodiments of the invention, a method for generating a charged particle beam includes providing an accelerator having a main body and an energy switch secured to the main body, the main body having a first end, a second end, and a plurality of electromagnetic cavities between the first and second ends, the first end secured to a gun source. The method further includes activating the gun source to create electrons, and accelerating the electrons using the electromagnetic cavities such that an envelop of electric field is generated along a length of the main body, the envelop having a first portion between the first end and the energy switch that is approximately uniform.

In accordance with other embodiments of the invention, a method for generating a charged particle beam includes providing an accelerator having a main body, the main body having a first end, a second end, and a plurality of electromagnetic cavities between the first and second ends, the first end secured to a gun source. The method further includes activating the gun source to create electrons, and accelerating the electrons using the electromagnetic cavities such that an electric field envelop along a length of the main body has a step.

Other and further aspects and features of the invention will be evident from reading the following detailed description of the preferred embodiments, which are intended to illustrate, not limit, the invention.

BRIEF DESCRIPTION OF THE DRAWINGS

The drawings illustrate the design and utility of preferred embodiments of the present invention, in which similar elements are referred to by common reference numerals. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
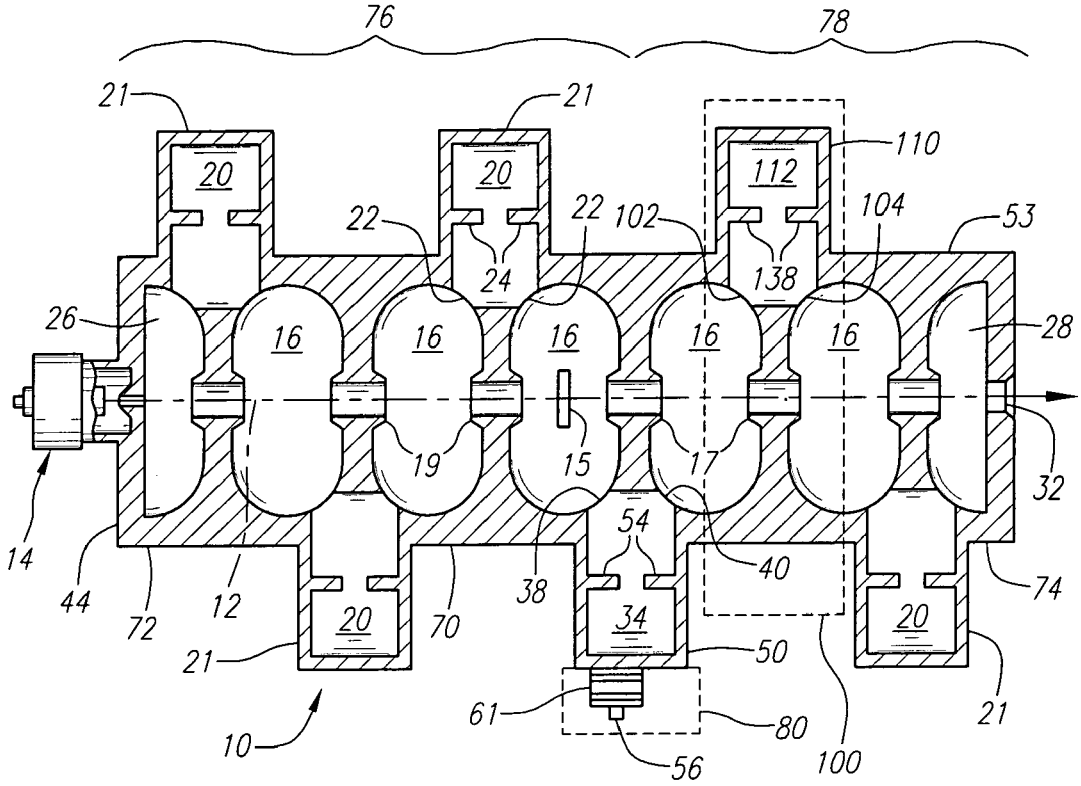
FIG. 1 is a schematic cross sectional view of a standing wave electron accelerator in accordance with some embodiments of the invention.

Various embodiments of the present invention are described hereinafter with reference to the figures. It should be noted that the figures are not drawn to scale and that elements of similar structures or functions are represented by like reference numerals throughout the figures. It should also be noted that the figures are only intended to facilitate the description of specific embodiments of the invention. They are not intended as an exhaustive description of the invention or as a limitation on the scope of the invention. In addition, an illustrated embodiment needs not have all the aspects or advantages of the invention shown. An aspect or an advantage described in conjunction with a particular embodiment of the present invention is not necessarily limited to that embodiment and can be practiced in any other embodiments of the present invention even if not so illustrated.

FIG. 1 is a schematic axial sectional view of a charged particle standing wave accelerator 10 embodying embodiments of the invention. The accelerator 10 comprises a main body 70 having a first end 72, a second end 74, and a chain of electromagnetically coupled resonant cavities (electromagnetic cavities) 16 between the first and second ends 72, 74. The accelerator 10 also includes a plurality of coupling bodies 21, each of which having a coupling cavity 20 that couples to two adjacent cavities 16. The accelerator 10 also has an energy switch 80 and a field step control 100. The standing wave accelerator 10 is excited by microwave power delivered by a microwave source at a frequency near its resonant frequency, for example, between 1000 MHz and 20 GHz, and more preferably, between 2800 and 3000 MHz. The microwave source can be a Magnetron or a Klystron, both of which are known in the art. The power enters one cavity 16, preferably one of the cavities along the chain, through an opening 15.

In some embodiments, the accelerator 10 is configured to be operated with an automatic frequency control, such as that described in U.S. Pat. No. 3,820,035, for controlling an operation of a microwave source. The automatic frequency control helps the microwave source (or the RF driver) determine the accelerator 10 resonance by developing an error voltage that tracks a frequency error. The U.S. Pat. No. 3,820,035 is expressly incorporated by reference herein. Alternatively, or additionally, a control, such as that disclosed in U.S. Pat. No. 3,714,592, can be provided to provide feedback to the microwave source (e.g., a Magnetron) by deflecting some of the reflected signal generated by the accelerator 10, and sending it back into the microwave source. U.S. Pat. No. 3,714,592 is expressly incorporated by reference herein.

In some embodiments, the wall 44 of the main body 70 adjacent to the gun source 14 can include one or more pump out holes (not shown) for improving molecular flow conductance, as is known in the art. In such cases, the accelerator 10 can further include a tuning ring (not shown) secured to an interior surface of the wall 44 for compensating the detuning from the pump out holes. The tuning ring can be manufactured with the wall 44 as a single unit. Alternatively, the tuning ring and the wall 44 can be manufactured separately, and then assembled together. Also, in some embodiments, the accelerator 10 can further include a copper plate, such as that described in U.S. Pat. No. 3,546,524, disposed at the interior face of the wall 44. The copper plate functions to terminate and shape the electric field.

During use, a linear beam 12 of electrons is injected into the accelerator 10 by a conventional electron gun source 14 at the first end 72. The beam 12 may be either continuous or pulsed. The beam 12 passes through a first section 76 of the accelerator 10 in which electrons are captured and accelerated, and enters a second section 78 of the accelerator 10 where the captured electrons are further accelerated. Amplitude of the electric field in the second section 78 (i.e., downstream) can be adjusted by operation of the energy switch 80. Since the formation of electron bunches from an initial continuous beam takes place in the first section 76 of the accelerator 10, the bunching can be accomplished and/or optimized there and not degraded by the varying accelerating field in the output cavities 16 of the second section 78. The spread of energies in the output beam is thus made independent of the varying mean output electron energy. By controlling the RF power input (which changes the relative electric field between the first and second sections 76, 78), and the energy switch 80 (which changes the electric field in the second section 78), one can optimize spectrum of energies and maintain stable charging (or filling) of the accelerator 10.

The field step control 100 provides a change in the electric field (e.g., a stepped field) to decrease the range of field variation associated with operation of the energy switch 80. This use of field step has an effect of decreasing separations of resonant modes of the accelerator 10, so that an optimum range of beam energies can be generated. This in turn results in a relatively stable bandwidth, allowing the accelerator 10 to generate x-ray beam with a wider range of energy levels and minimum energy spread. In some embodiments, the field step control 100 enables the accelerator 10 to generate x-ray beam having an energy level that ranges from approximately 4 to 20 MeV. In the illustrated embodiments, the field step control 100 is located further away from the beam source 14 than the energy switch 80, and is positioned adjacent to the energy switch 80. Alternatively, the field step control 100 can be located at other positions, such as between the beam source 14 and the energy switch 80, or further downstream from the energy switch 80. The field step control 100 will be described in further detail below. After being accelerated, the beam 12 strikes an x-ray target 32. The target 32 may be a vacuum window of metal thin enough to transmit the electrons for particle irradiation of a subject. In alternative embodiments, the accelerator 10 does not include the target 32. In such cases, the target 32 can be located remotely from the accelerator 10.

In the illustrated embodiments, the electromagnetic cavities 16 are doughnut shaped with aligned central beam apertures 17 which permit passage of the beam 12. The main body 70 defining the cavities 16 has an outer cross sectional dimension approximately equal to the wavelength (λ) of the RF source, each cavity 16 has a cross sectional dimension approximately equal to 0.7 λ to 0.9 λ, and the beam aperture 17 has a cross sectional dimension approximately equal to 0.05 λ to 0.07 λ. Also, in the illustrated embodiments, the distance between adjacent walls that separate the cavities 16 is approximately 0.3 λ to 0.5 λ for the cavities 16 that are between the beam source 14 and the energy switch 80, and the distance between adjacent walls that separate the cavities 16 is approximately 0.5 λ for the cavities 16 that are to the right of the energy switch 80. In alternative embodiments, the cavities 16, the apertures 17, and other components of the accelerator 10 can have other shapes and/or dimensions. In some embodiments, the dimensions and/or spacing of the cavities 16 in the first section 76 are configured to improve capture, bunching, and phasing of electrons. In the illustrated embodiments, the apertures 17 each has a substantially uniform cross section. Alternatively, the aperture 17 that is adjacent to the beam source 14 can have a varying cross section, such as a tapered profile. The cavities 16 preferably have projecting noses 19 of optimized configuration in order to improve efficiency of interaction of the microwave power and electron beam. The cavities 16 are electromagnetically coupled together through the coupling cavities 20, each of which is coupled to each of the adjacent pair of cavities 16 by an opening 22. In the illustrated embodiments, each of the openings 22 has a rectangular shape, and has a width of 0.045 λ and a length of 0.3 λ. In alternative embodiments, the opening 22 can have other shapes and dimensions. The coupling cavities 20 are resonant at the same frequency as the accelerating cavities 16 and do not interact with the beam 12. In the illustrated embodiments, the coupling cavities 20 are of cylindrical shape with a pair of axially projecting conductive capacitively coupled noses 24. Alternatively, the coupling cavities 20 can have other shapes and configurations.

The frequency of excitation is such that the chain is excited in standing wave resonance with a π/2 radian phase shift between each coupling cavity 20 and the adjacent accelerating cavity 16. Thus, there is a π radian shift between adjacent accelerating cavities 16. The π/2 mode has several advantages. It has the greatest separation of resonant frequency from adjacent modes which might be accidentally excited. Also, when the chain is properly terminated, there are very small electromagnetic fields in coupling cavities 20 so the power losses in these non-interacting cavities are small. The first and last accelerating cavities 26 and 28 are shown as having one-half of an interior cavity 16. It is of course understood that, in alternative embodiments, the terminal cavities 26, 28 may each be a full cavity or any portion of a cavity. The spacing between accelerating cavities 16 is about one-half of a free-space wavelength, so that electrons accelerated in one cavity 16 will arrive at the next accelerating cavity in right phase relative to the microwave field for additional acceleration. Alternatively, the accelerating cavities 16 can have other spacing. In some embodiments, most of the accelerating cavities 16 and most of the coupling cavities 20 are similar such that the fields in most of the accelerating cavities 16 are substantially the same. Alternatively, the accelerating cavities 16 and/or the coupling cavities 20 can have other configurations such that the fields in some of the cavities 16 are different.

In the illustrated embodiments, the first section 76 (i.e., the "buncher". section) has 3½ cavities 16, and the second section 78 (i.e., the "accelerating" section) of the accelerator 10 has 2½₆ cavities 16. However, the scope of the invention should not be so limited. Alternatively, each of the sections 76, 78 of the accelerator 10 can have other number of cavities 16. For example, in some embodiments, the first section 76 of the accelerator 10 can have seven electromagnetic cavities 16, and the second section 78 of the accelerator 10 can have twenty electromagnetic cavities 16.

Figure 2:
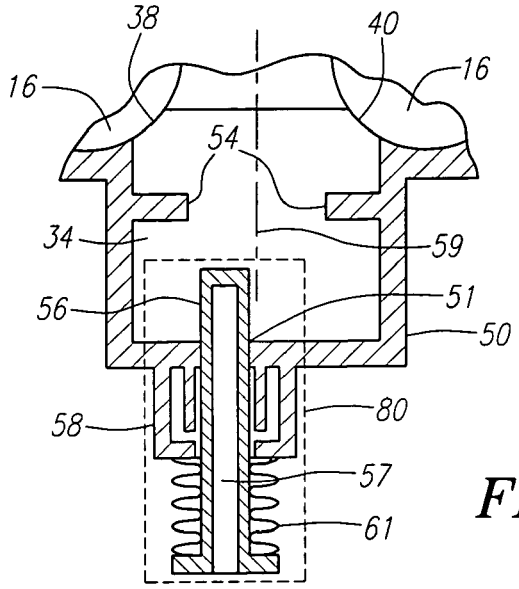
FIG. 2 illustrates an energy switch of the accelerator of FIG. 1 in accordance with some embodiments of the invention.

FIG. 2 shows the energy switch 80 of the accelerator 10 in accordance with some embodiments of the invention. The energy switch 80 is mounted to a cylindrical cup-shaped body 50 having a cavity 34 and an opening 51, and includes a probe 56 inserted through the opening 51, and a choke 58 coaxially surrounding at least part of the probe 56. The choke 58 is a double quarter-wave choke configured to facilitate transmission of high current around the opening 51 by functioning as an impedance transformation of short circuit to opened circuit. The body 50 is attached to the main body 70 of the accelerator 10 such that the cavity 34 is coupled to adjacent cavities 16 through respective openings 38, 40. The energy switch 80 also includes a pair of axially projecting conductive capacitively coupled noses 54 having opposed end faces that extend axially into the cavity 34. The body 50 and the noses 54 are similar to the body 21 and noses 24 discussed previously. In some embodiments, the cavity 34 (the switched side-cavity) is tuned to the same frequency as are the other coupling cavities 20. Such can be accomplished, for example, by varying a diameter or cross sectional dimension of the probe 56 when the probe 56 is at least partially inserted into the cavity 34. Alternatively, the tuning can be accomplished by varying separation between the noses 54 when the probe is not inserted into the cavity 34.

The probe 56 is positioned such that it is offset from a center line 59 of the body 50. In the illustrated embodiments, the probe 56 is located upstream of the center line 59 of the body 50. Alternatively, the probe 56 can be located downstream of the center line 59. The probe 56 is preferably circular cylinder although it could have other cross sectional shapes. In the illustrated embodiments, the probe 56 is made from stainless steel, but can also be made from other materials. The probe 56 has a lumen 57 extending along its length. During use, cooling fluid can be delivered into the lumen 57 (e.g., via another tube inserted coaxially into the lumen 57) for cooling of the probe 56. In alternative embodiments, the probe 56 has a solid cross section and does not have a lumen. The use of a single probe provides physical room for the mechanisms which engage the end of the probe 56 to advance and retract the probe 56 without mechanical interference. The mechanism (not shown) can comprise electrically actuated solenoid(s) or pneumatically operated cylinder(s). Movement of the probe 56 is through the vacuum wall via bellows 61, which provides a vacuum seal. During use, the pair of noses 54 function as coupling resonators, and the probe 56 functions as a third resonator. By varying a degree of insertion of the probe 56 into the cavity 34, distances between the probe 56 and the noses 54 change correspondingly, thereby altering the magnetic fields which couple to the openings 38, 40. This in turn alters the energy level of the beam downstream from the switch 80.

It should be noted that the type of switch that can be employed with the accelerator 10 is not necessarily limited to the example discussed previously, and that other types of switches known in the art can also be used. By means of non-limiting examples, accelerator switches such as those described in U.S. Pat. Nos. 4,382,208 and 4,286,192, can be used. U.S. Pat. No. 6,366,021 teaches switching electric fields in a coupling cavity by inserting two probes of selected diameter to provide different upstream and down stream electric field coupling to adjacent accelerating cavities. U.S. Pat. Nos. 6,366,021, 4,382,208, and 4,286,192 are expressly incorporated by reference herein. Also, in alternative embodiments, the energy switch 80 can be located at other position along the length of the accelerator 10, instead of that shown in the illustrated embodiments. Furthermore, although only one energy switch is shown in the previously described embodiments, alternatively, the accelerator 10 can have a plurality of energy switches.

Figure 3:
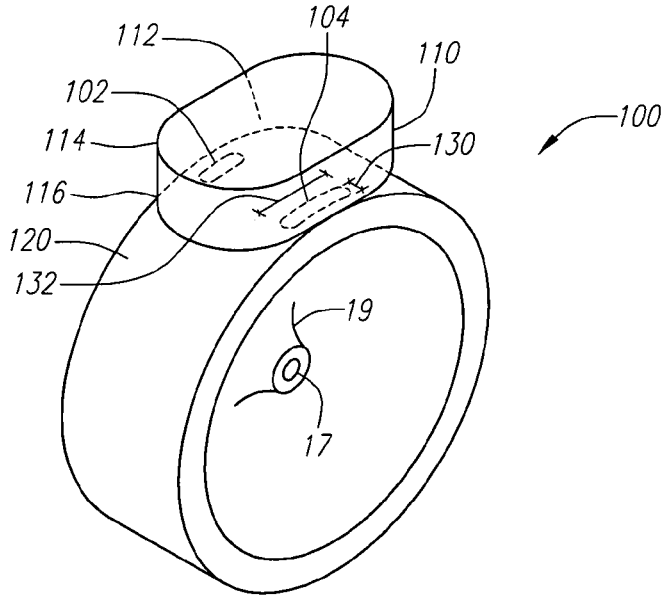
FIG. 3 is a perspective view of a field step control of the accelerator of FIG. 1 in accordance with some embodiments of the invention.

FIG. 3 shows a perspective view of the field step control 100 of the accelerator 10 in accordance with some embodiments of the invention. The field step control 100 includes a coupling body 110 having a first end 114, a second end 116, and a cavity 112 between the first and the second ends 114, 116, and a structure 120. The first end 114 of the body 110 is sealed, and the second end 116 is secured to the structure 120. In the illustrated embodiments, the structure 120 is a portion of the main body 70 of the accelerator 10 (i.e., a segment along the length of the accelerator 10). Alternatively, the structure 120 can be other part(s) of the accelerator 10, such as a side wall defining parts of the adjacent electromagnetic cavities 16. The coupling body 110 is similar to the coupling body 21 discussed previously. In the illustrated embodiments, the coupling body 110 has a rectangular shape. Alternatively, the coupling body 110 can have other shapes and configurations, such as a semi-circular shape, or a cylindrical shape. In some embodiments, the coupling body 110 is configured to have the same resonant frequency as that of the coupling bodies 21. The coupling body 110 can be manufactured together with the main body 70. Alternatively, the coupling body 110 and the main body 70 (or the structure 120 that is a part of the main body 70) can be separately manufactured and then assembled together.

The field step control 100 further includes a pair of axially projecting conductive capacitively coupled noses 138 (not shown in FIG. 3 for clarity purpose). The noses 138 have equal lengths and shapes, and are secured to interior side walls of the coupling body 110. Although the noses 138 can have unequal lengths and/or shapes in alternative embodiments, such configurations will reduce efficiency of the field step control 100, and therefore, are less desirable.

Figure 4:
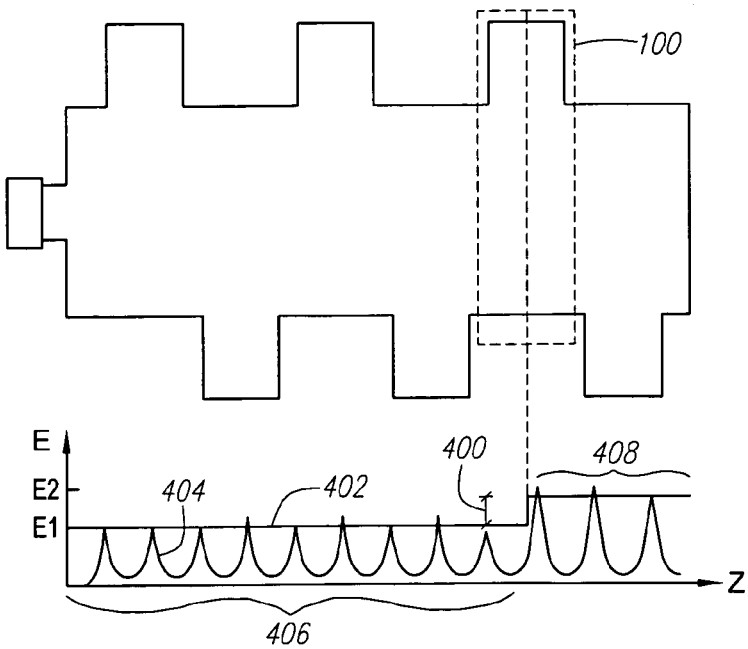
FIG. 4 is a diagram illustrating an idealized energy field envelop of the accelerator of FIG. 1.

As shown in FIG. 3, the field step control 100 also includes a first opening 102 and a second opening 104 at the second end 116 of the coupling body 110. The first opening 102 is configured to couple the cavity 112 to one of the electromagnetic cavities 16, and the second opening 104 is configured to couple the cavity 112 to another of the electromagnetic cavities 16. The openings 102, 104 have different configurations. In the illustrated embodiments, the openings 102, 104 both have a rectangular shape. However, in alternative embodiments, the openings 102, 104 can have other shapes, such as a circular shape, an elliptical shape, or a trapezoidal shape. Also in the illustrated embodiments, the first opening 102 is larger, or has a larger cross sectional dimension that is larger, than that of the second opening 104. Such configuration allows an envelop 402 of electric field to be created such that there is a change of energy level (e.g., a step 400) at the position of the field step control 100 along the length of the accelerator 10 (FIG. 4). FIG. 4 also shows the actual electric profile 404 associated with the envelop 402. Although the envelop 402 has a first region 406 and a second region 408 that are approximately uniform (i.e., flat), in alternative embodiments, either or both of the first and the second regions 406, 408 can be slopped. In the illustrated embodiments, both of the first and the second openings 102, 104 have a width of 0.05 λ, the first opening 102 has a length 132 of 0.35 λ, and the second opening 104 has a length 132 of 0.31 λ. In alternative embodiments, the first and second openings 102, 104 can have other dimensions such that a desired field step can be generated. It should be noted that the configurations of the openings 102, 104 should not be limited to the example discussed previously, and that the openings 102, 104 can have other configurations. For example, in alternative embodiments, the first opening 102 can have a cross sectional dimension that is smaller than that of the second opening 104. In such cases, the resulting field step would have a step-down configuration. Furthermore, in alternative embodiments, the first opening 102 can have a shape that is different from that of the second opening 104.

The field step 400 preferably has a magnitude such that an energy level E2 to the right of the field step control 100 is approximately in the range of 1 to 2 times; and more preferably, 1.3 to 1.5 times, an energy level E1 to the left of the field step control 100. However, in alternative embodiments, the field step 400 can have other magnitudes. A field step energy ratio r(=E2/E1) that is close to 1 would provide more stability (i.e., less interference due to interaction of adjacent modes) than a field step energy ratio that is close to 2. However, a field step energy ratio r that is close to 2 would provide a better operational range (i.e., a wider range of energy levels) than a field step energy ratio that is close to 1. Although the field step control 100 has an effect of reducing separations between resonant modes, it allows the energy switch 80 to operate in a wider range of energy levels without significantly increasing interactions between adjacent modes. This in turn provides a broader bandwidth for the accelerator 10, allowing the accelerator 10 to generate x-ray beams with a broader range of energy levels and minimum energy spread. In some embodiments, the field step control 100 allows the accelerator 10 to generate x-ray beams having an energy level that ranges from 4 MeV to 20 MeV. In some cases, such configuration can provide seven different energy levels (i.e., 4, 6, 8, 10, 15, 18, and 20 MeV) with appropriate filters and/or targets. In other embodiments, the field step control 100 allows the accelerator 10 to generate x-ray beams in both the keV and MeV energy levels.

Thus there has been provided an accelerator in which the beam energy can be switched to a plurality of levels using a field step control and an energy switch. The field step control allows the accelerator to achieve a balance between optimized operational stability and optimized operational range. This in turn provides a broader bandwidth for the accelerator, allowing the accelerator to generate x-ray beams with a wider range of energy levels and minimum energy spread.

Figure 5:
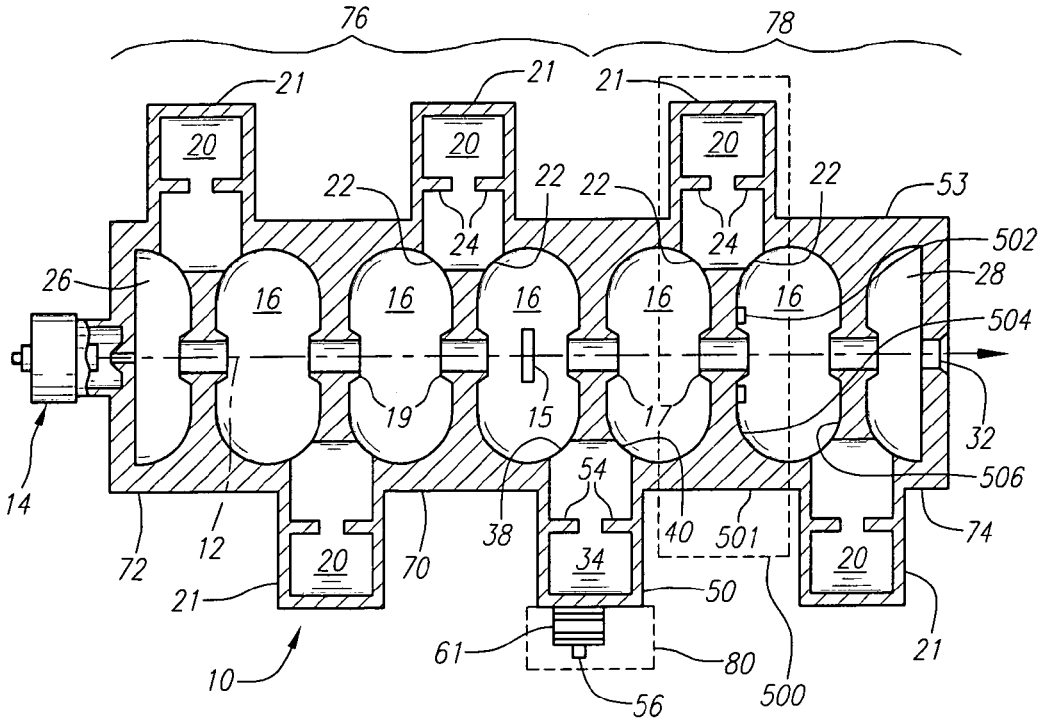
FIG. 5 is a schematic cross sectional view of a variation of the standing wave electron accelerator of FIG. 1, particularly showing a field step control having a ring shape structure in accordance with alternative embodiments of the invention.

It should be noted that other devices and methods can also be used to create field step for separation of resonant modes. FIG. 5 shows a field step control 500 in accordance with alternative embodiments of the invention. Unlike the field step control 100, the field step control 500 does not have the unequal openings 102, 104. In such case, the field step control 500 includes the coupling body 21, at least a portion 501 of the main body 70, and a ring 502. The ring 502 is secured to a dividing wall 504 that separates adjacent cavities 16. Such configuration has an effect of lowering the energy field at the location of the field step control 500. The ring 502 can be manufactured with the dividing wall 504 as a single unit. Alternatively, the ring 502 and the dividing wall 504 can be separately manufactured and then assembled together. The cross sectional size and shape of a portion of the ring 502 and the overall geometry of the ring 502 are configured such that a field step having a desired characteristic can be created. In the illustrated embodiments, the cross sectional shape of a portion of the ring 502 has a rectangular shape, but can have other shapes as well in alternative embodiments. Also, in alternative embodiments, the field step control 500 can include a second ring secured to an opposite side of the dividing wall 504, or to an adjacent wall 506. In some embodiments, a plurality of rings 502 can be secured to the dividing walls of the cavities 16 at the first section 76 of the accelerator 10. Such configuration creates an energy profile that is similar to that shown in FIG. 4. Furthermore, in alternative embodiments, instead of a ring, the field step control 500 can include other structure(s) having other shapes and/or configurations secured to the dividing wall 504.

Figure 6:
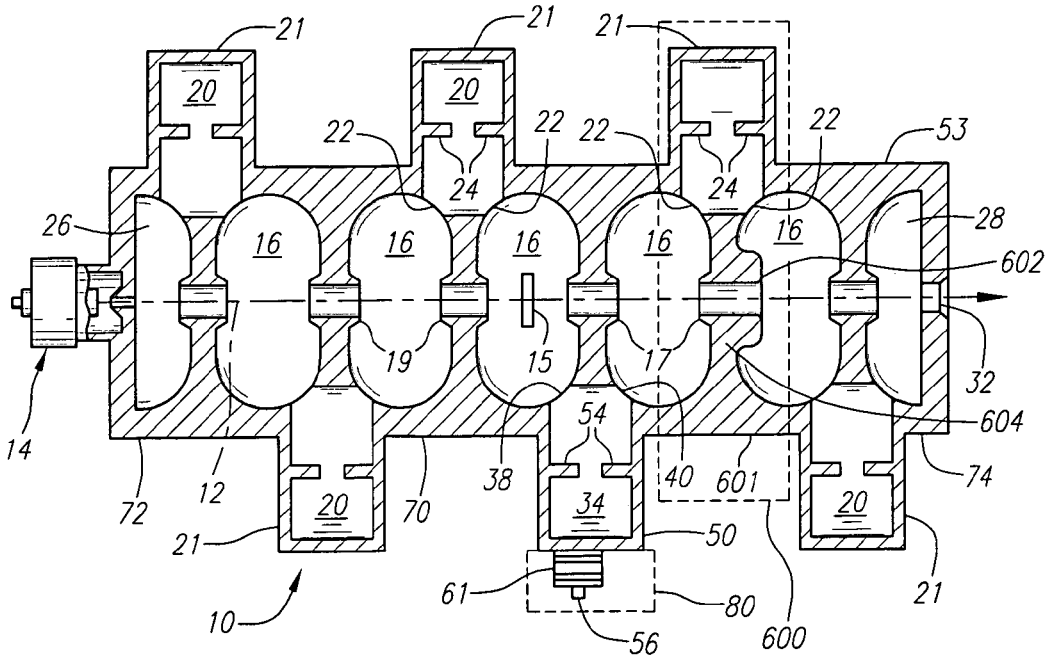
FIG. 6 is a schematic cross sectional view of a variation of the standing wave electron accelerator of FIG. 1, particularly showing a field step control having an enlarged nose in an accelerating cavity in accordance with alternative embodiments of the invention.

FIG. 6 shows another field step control 600 in accordance with alternative embodiments of the invention. The field step control 600 includes the coupling body 21, at least a portion 601 of the main body 70, and an enlarged nose 602 secured to a dividing wall 604 that separates the adjacent cavities 16. The nose 602 can have a variety of shapes, such as a circular shape, an elliptical shape, a rectangular shape, or other customized shape. The shape and size of the nose 602 is configured such that a field step having a desired characteristic can be created. Although only one enlarged nose 602 is shown, in alternative embodiments, the accelerator 10 can have a plurality of enlarged noses 602 at selected location(s) along the length of the accelerator 10.

Figure 7:
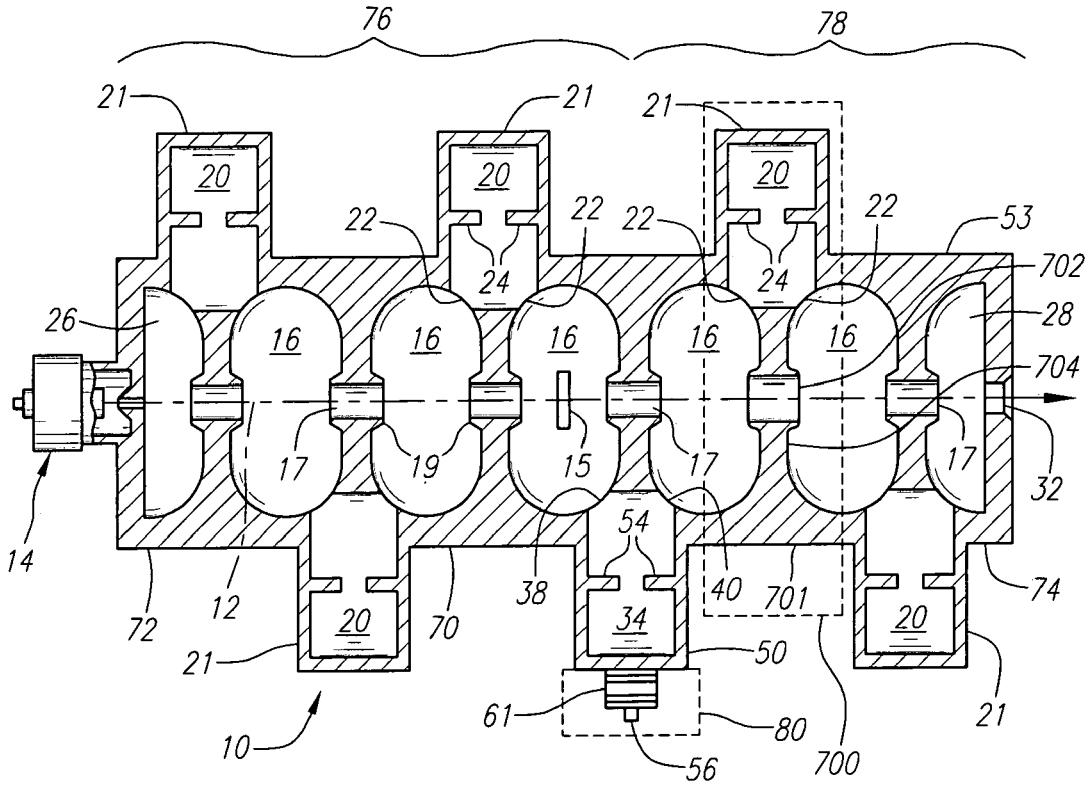
FIG. 7 is a schematic cross sectional view of a variation of the standing wave electron accelerator of FIG. 1, particularly showing a field step control having an enlarged central beam aperture in accordance with alternative embodiments of the invention.

FIG. 7 shows another field step control 700 in accordance with alternative embodiments of the invention. The field step control 700 includes the coupling body 21, at least a portion 701 of the main body 70, and a beam aperture 702 through a dividing wall 704 that separates the adjacent cavities 16. In the illustrated embodiments, the aperture 702 has a circular shape and is relatively larger than the beam apertures 17. In alternative embodiments, the aperture 702 can have other shapes, and can be relatively smaller than the beam apertures 17. The size and shape of the aperture 702 is configured such that a field step having a desired characteristic can be created. Also, in alternative embodiments, the accelerator 10 can have a plurality of the field step controls 700 located at other positions along the length of the accelerator 10.

Figure 8:
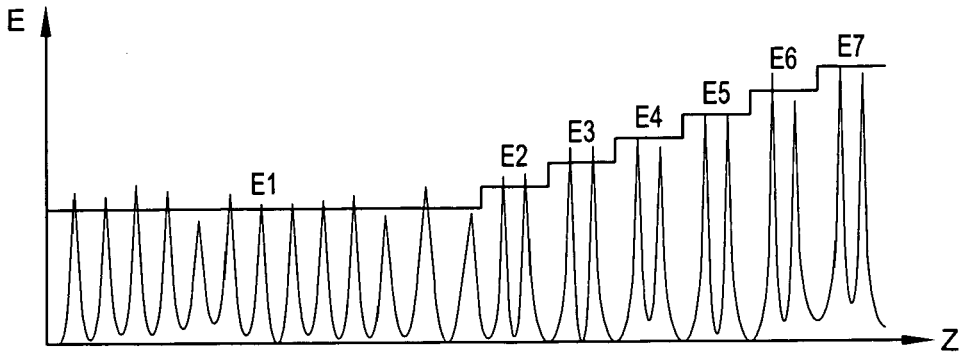
FIG. 8 is a diagram illustrating another idealized energy field envelop that can be created using field step controls.

Although the accelerator 10 has been described with reference to one field step control 100, the scope of the invention should not be so limited. In alternative embodiments, the accelerator 10 can have a plurality of field step controls for generating desired field step(s). For example, in some embodiments, a plurality of field step controls can be employed to create a series of field steps (FIG. 8). Also, in some embodiments, the accelerator 10 can include one or more field step controls 100 within the first section 76, or adjacent the beam source 14, for generating desired field steps.

Although particular embodiments of the present inventions have been shown and described, it will be understood that it is not intended to limit the present inventions to the preferred embodiments, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed is:

1. An accelerator for accelerating a particle beam, comprising:

a main body having a plurality of electromagnetic cavities coupled in series;

a first coupling body having a first side cavity coupled to two of the electromagnetic cavities, wherein the first side cavity is coupled to one of the two of the electromagnetic cavities through a first opening, and to another of the two of the electromagnetic cavities through a second opening, and wherein the first opening and the second opening have different sizes; and a second coupling body coupled to the main body, the second coupling body having a second side cavity in communication with a third opening and a fourth opening, wherein the third and the fourth openings have a same size.

2. The accelerator of claim 1, wherein the first opening and the second opening have different cross sectional dimensions.

3. The accelerator of claim 1, wherein the first opening and the second opening have different cross sectional shapes.

4. The accelerator of claim 1, wherein the first opening has a first cross sectional area, the second opening has a second cross sectional area, and the first cross sectional area is approximately 5% to 20% larger than the second cross sectional area.

5. An accelerator for accelerating a particle beam, comprising:

a main body having a plurality of electromagnetic cavities coupled in series; and a first coupling body having a first side cavity coupled to one of the electromagnetic cavities through a first opening, and to another of the electromagnetic cavities through a second opening, wherein the first opening and the second opening have different sizes;

a second coupling body having a second side cavity coupled to the main body; and an energy switch for changing an electric field distribution in the second side cavity.

6. The accelerator of claim 5, wherein the second side cavity is distal to a beam source, and the first side cavity is distal to the second side cavity.

7. The accelerator of claim 5, wherein the energy switch comprises a probe mounted for insertion into the second side cavity.

8. The accelerator of claim 7, wherein the diameter of the probe is selected to control an electric field distribution in the second side cavity.

9. The accelerator of claim 7, wherein varying a degree of insertion of the probe into the second side cavity changes an energy level of a x-ray beam generated by the accelerator.

10. The accelerator of claim 5, further comprising a gun source secured to a first end of the main body.

11. The accelerator of claim 10, wherein the first coupling body is not located between the first end and the second coupling body.

12. An accelerator for accelerating a particle beam, comprising:

a main body having a plurality of electromagnetic cavities coupled in series along an axis;

a coupling body having a side cavity coupled to two of the electromagnetic cavities; and an energy switch having only one probe for changing an electric field distribution in the side cavity;

wherein the probe has an axis that is parallel and offset from an axis of the coupling body, and varying a degree of insertion of the probe into the side cavity changes an electromagnetic field coupling between the two of the electromagnetic cavities.

13. The accelerator of claim 12, wherein the diameter of the probe is selected to control a frequency of the side cavity.

14. The accelerator of claim 12, wherein the probe has a lumen extending along its length.

15. The accelerator of claim 14, further comprising a fluid delivery tube disposed coaxially within the lumen of the probe.

16. The accelerator of claim 14, further comprising a choke coaxially surrounding at least a portion of the probe.

17. The accelerator of claim 12, further comprising a field step control for creating a desired electric field profile along the axis of the accelerator.

18. The accelerator of claim 17, wherein the side cavity is distal to a beam source, and the field step control is distal to the side cavity.

19. An accelerator for accelerating a particle beam, comprising:

a main body having a plurality of electromagnetic cavities coupled in series along an axis; and a device for generating a desired electric field profile along the axis to control separation of resonant modes of the electromagnetic cavities; wherein the device comprises:

a coupling body having a cavity that couples to one of the electromagnetic cavities through a first opening, and to another of the electromagnetic cavities through a second opening, wherein the first and the second openings have different sizes; and a pair of conductive capacitively coupled noses secured to side walls of the coupling body, the pair of noses having equal lengths in a direction of the axis.

20. The accelerator of claim 1, further comprising:

a ring structure secured to a dividing wall that separates two of the electromagnetic cavities.

21. An accelerator for accelerating a particle beam, comprising:

a main body having a plurality of electromagnetic cavities coupled in series along an axis; and a device for generating a desired electric field profile along the axis to control separation of resonant modes of the electromagnetic cavities; wherein the device comprises a dividing wall that separates two of the electromagnetic cavities, and a beam aperture for allowing the particle beam to travel therethrough, the beam aperture having a cross sectional dimension that is different from that of an adjacent beam aperture.

22. An accelerator for accelerating a particle beam, comprising:

a main body having a plurality of electromagnetic cavities coupled in series;

a first coupling body having a first side cavity coupled to two of the electromagnetic cavities, wherein the first side cavity is coupled to one of the two of the electromagnetic cavities through a first opening, and to another of the two of the electromagnetic cavities through a second opening, wherein the first opening and the second opening have different shapes; and a second coupling body coupled to the main body, the second coupling body having a second side cavity in communication with a third opening and a fourth opening, wherein the third and the fourth openings have a same shape.

23. The accelerator of claim 22, further comprising a pair of conductive capacitively coupled noses secured to side walls of the first coupling body.

24. The accelerator of claim 22, wherein the first opening and the second opening have different cross sectional dimensions.

25. The accelerator of claim 22, wherein the first opening has a first cross sectional area, the second opening has a second cross sectional area, and the first cross sectional area is approximately 5% to 20% larger than the second cross sectional area.

26. An accelerator for accelerating a particle beam, comprising:

a main body having a plurality of electromagnetic cavities coupled in series; and a first coupling body having a first side cavity coupled to one of the electromagnetic cavities through a first opening, and to another of the electromagnetic cavities through a second opening, wherein the first opening and the second opening have different shapes;

a second coupling body having a second side cavity coupled to the main body; and an energy switch for changing an electric field distribution in the second side cavity.

27. The accelerator of claim 1, further comprising a pair of conductive capacitively coupled noses secured to side walls of the first coupling body, wherein the pair of noses have equal lengths.

28. The accelerator of claim 1, wherein the one of the electromagnetic cavities and the another of the electromagnetic cavities have a same shape.

29. The accelerator of claim 12, wherein the two of the electromagnetic cavities have a same shape.

30. The accelerator of claim 19, wherein the one of the electromagnetic cavities and the another of the electromagnetic cavities have a same shape.

31. The accelerator of claim 1, wherein the second coupling body is coupled to another two of the plurality of electromagnetic cavities, the second side cavity of the second coupling body coupled to one of the another two of the electromagnetic cavities through the third opening, and to another of the another two of the electromagnetic cavities through the fourth opening.

32. The accelerator of claim 22, wherein the second coupling body is coupled to another two of the plurality of electromagnetic cavities, the second side cavity of the second coupling body coupled to one of the another two of the electromagnetic cavities through the third opening, and to another of the another two of the electromagnetic cavities through the fourth opening.

33. The accelerator of claim 20, wherein the dividing wall has an aperture for allowing the particle beam to travel therethrough, and wherein the ring structure has an opening that is in communication with the aperture.

* * * * *